US008038590B2

(12) United States Patent
Narita et al.

(10) Patent No.: US 8,038,590 B2
(45) Date of Patent: Oct. 18, 2011

(54) CONDUCTIVE MEMBER, PROCESS CARTRIDGE HAVING THE SAME, AND IMAGE FORMING APPARATUS HAVING THE PROCESS CARTRIDGE

(75) Inventors: Yutaka Narita, Sagamihara (JP); Makoto Nakamura, Ebina (JP); Akiko Tanaka, Atsugi (JP); Taisuke Tokuwaki, Sagamihara (JP); Tadayuki Oshima, Atsugi (JP); Hiroki Furubayashi, Atsugi (JP)

(73) Assignee: Ricoh Company, Ltd., Tokyo (JP)

( * ) Notice: Subject to any disclaimer, the term of this patent is extended or adjusted under 35 U.S.C. 154(b) by 1372 days.

(21) Appl. No.: 11/441,042

(22) Filed: May 26, 2006

(65) Prior Publication Data

US 2006/0270541 A1 Nov. 30, 2006

(30) Foreign Application Priority Data

May 27, 2005 (JP) ..... 2005-155790

(51) Int. Cl.
*B05C 1/08* (2006.01)
*G03G 15/02* (2006.01)

(52) U.S. Cl. ..... 492/25; 492/28; 492/47; 492/49; 492/52; 492/56; 29/895.212; 29/895.213; 29/525; 399/176

(58) Field of Classification Search ..... 492/25, 492/28, 47, 49, 52, 53, 56; 29/525, 895, 29/895.2, 895.21, 895.211, 895.212, 895.213, 29/895.22, 895.3
See application file for complete search history.

(56) References Cited

U.S. PATENT DOCUMENTS 3,811,367 A * 5/1974 Bimba ..... 92/165 R
5,205,663 A * 4/1993 Stephenson et al. ..... 400/662
5,440,374 A * 8/1995 Kisu ..... 399/176
5,543,899 A * 8/1996 Inami et al. ..... 399/176
6,042,048 A * 3/2000 Czuprynski et al. ..... 242/613
6,766,123 B2 * 7/2004 Ebihara et al. ..... 399/66
6,889,023 B2 * 5/2005 Suda et al. ..... 399/176
7,155,146 B2 * 12/2006 Kosuge et al. ..... 399/168
7,693,456 B2 * 4/2010 Narita et al. ..... 399/176
2003/0175046 A1 * 9/2003 Namiki et al. ..... 399/176
2005/0100365 A1 5/2005 Narita et al.

FOREIGN PATENT DOCUMENTS

EP 1 191 403 A2 3/2002
JP 63-149668 6/1988
JP 1-267667 10/1989
JP 3-240076 10/1991
JP 4-358175 12/1992
JP 2000-275933 10/2000

(Continued)

OTHER PUBLICATIONS

U.S. Appl. No. 11/620,365, filed Jan. 5, 2007, Oshima, et al.

(Continued)

*Primary Examiner* — Sarang Afzali
(74) *Attorney, Agent, or Firm* — Oblon, Spivak, McClelland, Maier & Neustadt, L.L.P.

(57) ABSTRACT

A conductive member (10) includes a conductive supporting body (1), an electric resistance adjusting layer (2), which is formed onto the conductive supporting body (1) and is disposed to face a photoconductor (4), and a pair of space holding members (3, 3) disposed in both ends of the electric resistance adjusting layer (2), so as to have contact with the photoconductor (4) to maintain a predetermined gap (G) between the electric resistance adjusting layer (2) and the photoconductor, and each of the space holding members (3, 3) includes a cylinder portion (3*a*) attached to the outer circumference surface (2*a*) of the electric resistance adjusting layer and an end plate (3*b*) provided in one end portion of the cylinder portion and disposed to have contact with the end surface (2*b*) of the electric resistance adjusting layer.

13 Claims, 4 Drawing Sheets

FOREIGN PATENT DOCUMENTS

| | | |
|---|---|---|
| JP | 2001-296723 | 10/2001 |
| JP | 2002-139893 | 5/2002 |
| JP | 2002-258581 | 9/2002 |
| JP | 2004-258064 | 9/2004 |
| JP | 2004-354477 | 12/2004 |
| JP | 2005-017625 | 1/2005 |
| JP | 2005-91818 | 4/2005 |
| JP | 2005-266774 | 9/2005 |

OTHER PUBLICATIONS

U.S. Appl. No. 12/044,521, filed Mar. 7, 2008, Oshima, et al.
U.S. Appl. No. 11/340,533, filed Jan. 27, 2006, Narita, et al.
U.S. Appl. No. 11/837,751, filed Aug. 13, 2007, Nakamura, et al.
U.S. Appl. No. 11/836,950, filed Aug. 10, 2007, Tokuwaki, et al.
U.S. Appl. No. 11/854,947, filed Sep. 13, 2007, Oshima, et al.

* cited by examiner

CONDUCTIVE MEMBER, PROCESS CARTRIDGE HAVING THE SAME, AND IMAGE FORMING APPARATUS HAVING THE PROCESS CARTRIDGE

BACKGROUND

1. Field of the Invention

The present invention relates to a conductive member used in an image forming apparatus such as a copying machine, laser beam printer and facsimile, a process cartridge having the conductive member, and an image forming apparatus having the process cartridge.

2. Related Art

There has been used a conductive member as a charging member, which performs a changing process to a photoconductor, photoconductive drum, or image carrier, or as a transferring member, which performs a transferring process to toner on a photoconductor, in an image forming apparatus of electrophotographic system such as a conventional electrophotographic copying machine, laser beam printer and facsimile.

FIG. 9 illustrates an image forming apparatus 120 of electrophotographic system having a conventional charging roller. The image forming apparatus 120 of electrophotographic system comprises a photoconductive drum 102 on which an electrostatic latent image is formed, a charging roller 102, which has contact with the photoconductive drum 101 to perform a charging process, an exposure device 103 such as leaser beam, a developing roller 104, which transfers toner to the electrostatic latent image of the photoconductor drum 101, a power pack 105, which applies DC voltage to the charging roller 102, a transfer roller 106, which transfers a toner image on the photoconductive drum 101 onto a recording paper 107, a cleaning device 108, which cleans the photoconductive drum 101 after the transfer process, and a surface potential meter 109, which measures the surface potential of the photoconductive drum 101.

This image forming apparatus 120 of electrophotographic system includes a process cartridge detachable system. More particularly, in the image forming apparatus 120 of electrophotographic system, the process cartridge 110 having the photoconductive drum 101, charging roller 102, developing roller 104 and cleaning device 108 can be detachably attached to the body of image forming apparatus. The process cartridge 110 needs to comprise at least the photoconductive drum 101 and charging roller 102. This process cartridge 110 is attached to a predetermined position of the body of image forming apparatus. Thereby, the process cartridge 110 is connected to a driving system and electric system disposed in the body of image forming apparatus. Moreover, a functional unit normally required for another electrophotographic process is omitted in FIG. 9 because it is not required in the present invention.

Next, the basic image forming operation of the conventional image forming apparatus 120 of electrophotographic process will be explained.

If DC voltage is applied to the charging roller 102, which has contact with the photoconductive drum 101, from the power pack 105, the surface of the photoconductive drum 101 is equally charged at high potential. After that, if the image light is irradiated to the surface of photoconductive drum 101 by the exposure device 103, the electric potential is decreased in the irradiated portion of the photoconductive drum 101. Such charging mechanism to the surface of photoconductive drum 101 by the charging roller 102 has been known as discharge according to Paschen rule in a micro space between the charging roller 102 and the photoconductive drum 101.

Since image light is distribution of light volume corresponding to white/black of an image, if the image light is irradiated, electric potential distribution, i.e., an electrostatic latent image corresponding to a recording image is formed on the surface of the photoconductive drum 101 by the irradiated image light. If the portion of the photoconductive drum 101 formed with such an electrostatic latent image passes through the developing roller 104, toner is transferred depending on the high-low potential, and a toner image that the electrostatic image is visualized is formed onto the photoconductive drum 101. A recording paper 107 is fed to the portion of the photoconductive drum 101 formed with the toner image by a resist-roller (not shown) at a predetermined timing, and overlaps the toner image. After this toner image is transferred to the recording paper by a transfer roller 106, the recording paper 107 is separated from the photoconductive drum 101. The separated recording paper 107 is fed via a feeding path, and is thermally fixed by a fixing unit (not shown). Thereafter, the recording paper 107 is discharged outside the body of image forming apparatus. If the transferring is completed as described above, the surface of photoconductive drum 101 is cleaned by the cleaning device 108, and also the residual charge on the surface is eliminated by a quenching lamp (not shown). Therefore, the image forming apparatus is ready for a next image forming process.

There has been known a contact charging method, which brings a charging roller into contact with a photoconductor drum, as a charging method using a conventional charging roller (reference to JP S63-149668A and JP H01-267667A). However, such a conventional contact charging method has following problems.

(1) A material comprising a charging roller exudes from the charging roller, and the material adheres to a surface of a body to be charged. Thereby, the charging roller mark remains on the surface of body to be charged.

(2) If direct voltage is applied to a charging roller, the charging roller, which has contact with a body to be charged, shakes, resulting in generation of charging sound.

(3) Since toner on a photoconductive drum is adhered to a charging roller (especially, toner is easily adhered by the above exuding), a charging performance of charging roller is reduced.

(4) A material comprising a charging roller is adhered to a photoconductor drum.

(5) When stopping a photoconductive drum for a long time, a charging roller is deformed permanently.

A charging device having a close charging method, which allows a charging roller to come close to a photoconductive drum, has been proposed as an art for solving the above problems (reference to JP H03-240076A and JP H04-358175A). In the charging device having this close charging method, the charging roller faces the photoconductor drum to be the closest distance (50-300 μm), and the photoconductive drum is charged by the voltage applied to the charging roller. In the charging device with the close charging method, since the roller does not have contact with the photoconductive drum, the material comprising the charging roller is not adhered to the photoconductive drum and the roller is not permanently deformed when the drum is stopped for a long time. Accordingly, the above problems of the charging device with the conventional contact charging method are solved. Moreover, in the charging device with the close charging method, the amount of toner to be adhered to the charging roller is reduced, so the toner on the photoconductive drum, etc., is unlikely adhered to the charging roller. Therefore, the charging device with the close charging method is a superior charging device.

In a charging device with a close charging method described in JP H03-240076A and JP H04-358175A, spacer ring layers are attached to both end portions of a charging roller in order to maintain a gap between the charging roller and a photoconductive drum. However, in the charging device with this close charging method, since an accurate gap is not considered, the gap between the charging roller and the photoconductive drum is fluctuated by variations in the dimensional accuracy of the charging roller and spacer rings. Thereby, the charging potential of photoconductive drum is fluctuated. Therefore, toner is adhered to a white background when forming an image; thus, an image error is generated.

In order to solve the above problem, there has been proposed a charging device including tape-based space holding members each having a predetermined thickness (reference to JP2002-139893A). However, if the charging device including the tape-based space holding members is used for a extended period, the tape-based space holding members are worn away, or toner enters between the charging roller and the tape-based space holding members and is fixed therebetween. Thereby, the gap is not maintained between the surface of photoconductive drum and the surface of charging roller. Moreover, in the charging device including this tape-based space holding members, a highly accurate gap is not formed because of variations in the thickness of tape-based space holding members.

Consequently, the present inventors have proposed a charging member 210. As shown in FIG. 10, the charging member 210 comprises a conductive supporting body 201, an electric resistance adjusting layer 202 formed on the conductive supporting body 201, and space members 203, 203 formed in both ends of the electric resistance adjusting layer 202. Each of the space members 203, 203 comprises thermoplastic resin, which satisfies durometer hardness: HDD30-HDD70 and abrasion mass of taber type abrasion tester: 10 mg/1000 cycle or less (reference to JP2004-354477A).

This charging member 210 comprises a structure that the space members (space holding members) 203 are pressed into both end portions of the electric resistance adjusting layer 202. In this charging member 210, the space members 203 are formed in the end portions of electric resistance adjusting layer 202. Each of the space members 203 has contact with the end surface of the electric resistance adjusting layer 202 and the conductive supporting body 201. Therefore, long-period reliability is improved, compared to the tape-based space holding member. In addition, the gap can be accurately controlled by the simultaneously process (eliminating process) of the electric resistance adjusting layer 202 and the space members (space holding members) 203.

In such a charging member 210, the space members or space holding members 203 and the electric resistance adjusting layer 202 comprise a different material, each other, in consideration of fixing toner. However,. ionic conductive agent is used as resistance adjusting agent of the electric resistance adjusting layer 202, so the water-absorbing property of the electric resistance adjusting layer 202 is increased. Therefore, the electric resistance adjusting layer 202 absorbs moisture at high temperature and high moisture, and the measurement of electric resistance adjusting layer 202 is fluctuated. The space members 203 in the charging member 210 comprise olefin series resin, so the insulation property and toner fixing resistance are improved. However, this space members (space holding members) 203 have a small amount of measurement fluctuation at high temperature and high moisture, compared to the electric resistance adjusting layer 202. Therefore, the gap formed between the charging roller and image carrier at high accuracy is fluctuated by environmental fluctuation.

In order to solve such a problem, the present inventors have proposed a conductive member 310. As shown in FIG. 11, the conductive member 310 comprises a conductive supporting body 301, an electric resistance adjusting layer 302 formed on the conductive supporting body 301 and space holding members 303 disposed in both ends of this electric resistance adjusting layer 301. The electric resistance adjusting layer 302 comprises step portions or step portions having one step or more provided in the vicinity of both ends. The step portions are disposed in both ends direction, and the step portions having one step or more are disposed in the central direction. Each of the space holding members 303 has contact with two surfaces or more comprising the step portion of the electric resistance adjusting layer 302 to be fixed thereto (reference to JP2005-019517A).

However, in the conductive member 310, if a cutting process, grinding process and the like are performed onto the surfaces of thin space holding members 303, the space holding members 303 drop out of the electric resistance layer 302 or are deformed by the stress of the cutting tool. Therefore, the gap between the conductive member and the image carrier is fluctuated.

SUMMARY

It is, therefore, an object of the preset invention to provide a conductive member, a process cartridge having the conductive member, and an image forming apparatus having the process cartridge, which can prevent breaking off of space holding members from an electric resistance adjusting layer, the deformation of the shape of space holding members and the like, and also can control fluctuation of a gap when the measurement of electric resistance adjusting layer that the space holding members are disposed is changed, furthermore, can equally charge a surface of image carrier without generating abnormal electric discharge while constantly maintaining the accuracy of gap between the image carrier and conductive member.

In order to achieve the above object a conductive member according to one embodiment of the present invention comprises a conductive supporting body, an electric resistance adjusting layer, which is formed onto the conductive supporting body and is disposed to face a photoconductor, and a pair of space holding members disposed in both ends of the electric resistance adjusting layer, so as to have contact with the photoconductor to maintain a predetermined gap between the electric resistance adjusting layer and the photoconductor.

Each of the space holding members includes a cylinder portion attached to the outer circumference surface of the electric resistance adjusting layer and an end plate provided in one end portion of the cylinder portion and disposed to have contact with the end surface of the electric resistance adjusting layer.

PRIORITY CLAIM

The present application is based on and claims priority from Japanese Application No. 2005-155790, filed on May 27, 2005, the disclosures of which are hereby incorporated by reference herein in their entirety.

DETAILED DESCRIPTION OF THE PREFERRED EMBODIMENTS

Figure 1:
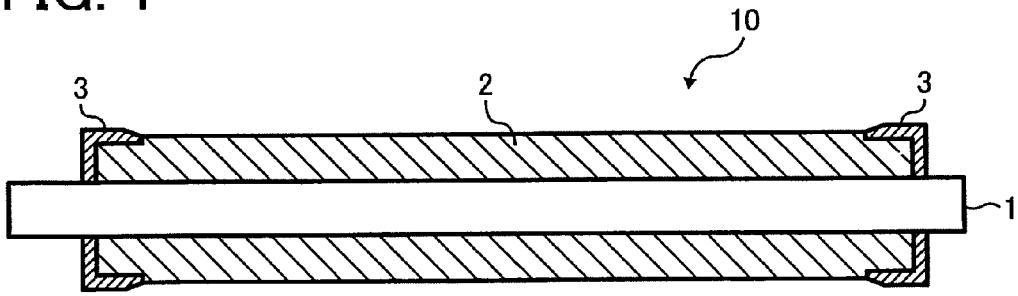
FIG. 1 is a cross section view of a conductive member (charging roller) showing one embodiment of the present invention.

Hereinafter, preferred embodiments of the present invention will be explained with reference to the drawings. FIG. 1 shows one embodiment of a conductive member according to the present invention. A conductive member 10 is formed as, for example, a charging roller used in an image forming apparatus of electrophotographic type such as an electrophotographic copying machine, laser beam printer and facsimile in the shown example.

Figure 7:
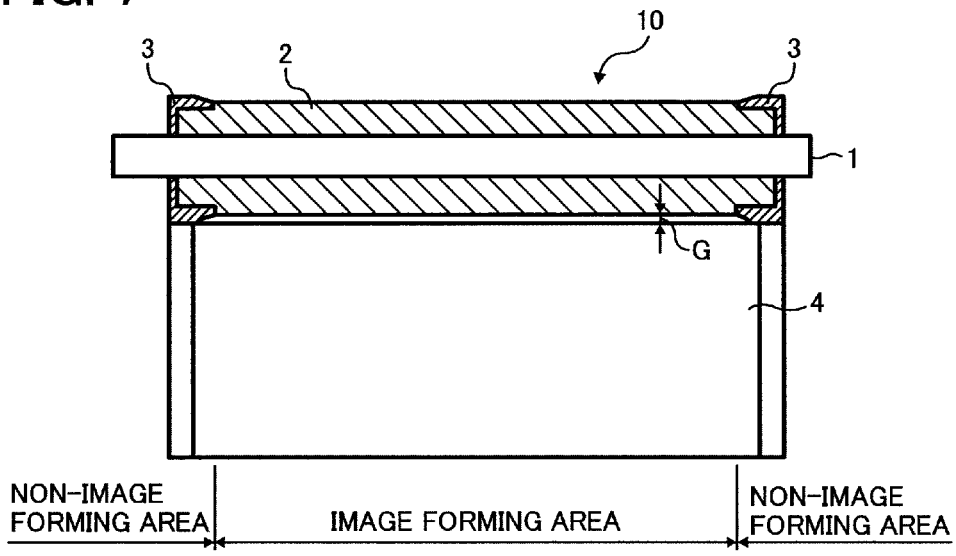
FIG. 7 is a schematic view showing a state that a conductive member (charging roller) is disposed on an image carrier.

The charging roller 10 comprises a long conductive supporting body 1, an electric resistance adjusting layer 2 formed on the conductive supporting body 1 and space holding members 3, 3 disposed in both ends of the electric resistance adjusting layer 2. The charging roller 10 is disposed to face a photoconductor, for example, an image carrier 4, and charges the image carrier 4 as shown in FIG. 7. In this case, the space holding members 3, 3 are disposed on both ends of the electric resistance adjusting layer 2 to have contact with non-image forming areas of the image carrier 4 such that the outer circumference surface of electric resistance adjusting layer 2 is disposed to face the outer circumference surface of the image carrier 4 in an image forming area of the image carrier 4 with a predetermined gap G (reference to FIG. 7).

Each of the space holding members 3, 3 is attached to each of the end portions of the electric resistance adjusting layer 2.

Figure 2:
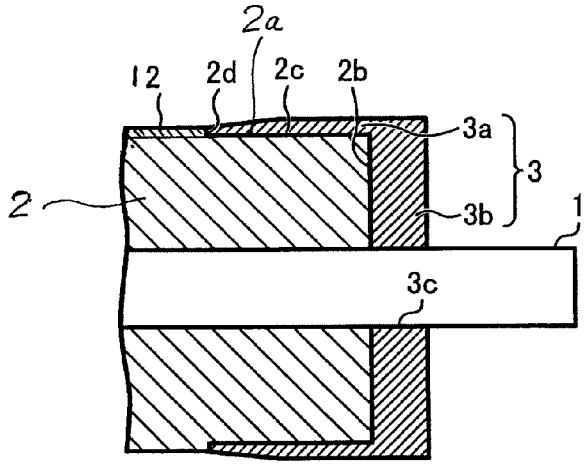
FIG. 2 is a partially enlarged cross section view of FIG. 1.
Figure 3:
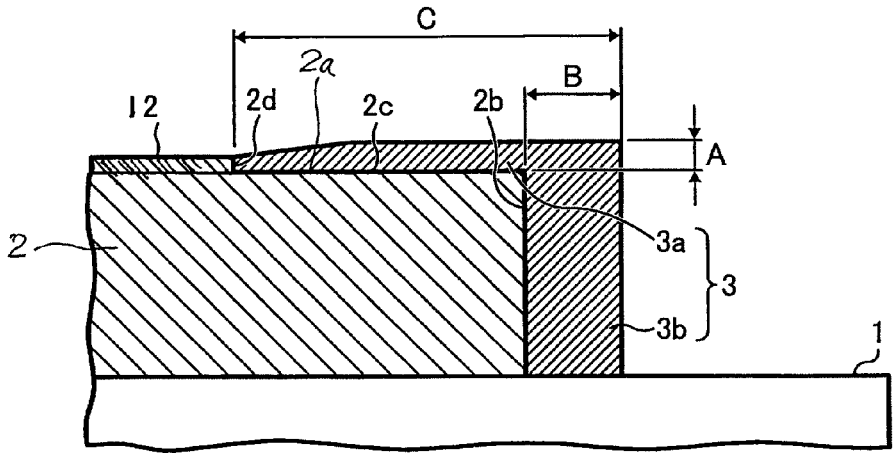
FIG. 3 is a partially enlarged cross section view of FIG. 2.
Figure 4:
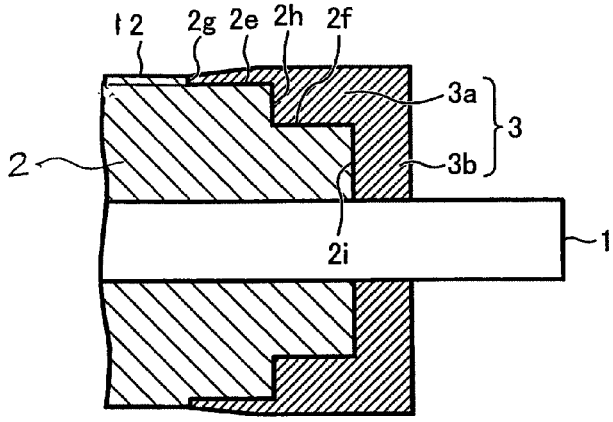
FIG. 4 is a partially enlarged cross section view of a conductive member (charging roller) showing another embodiment of the present invention.

More particularly, as shown in FIGS. 2 to 4, each of the space holding members 3, 3, comprises a cap shape including a cylinder portion 3*a* fitted to the end portion of the electric resistance adjusting layer 2 and an end plate 3*b* attached to one end of the cylinder portion 3*a*. An approximate center portion of each of the end plates 3*b* is provided with a hole 3*c* that the conductive supporting body 1 projecting from the electric resistance adjusting layer 2 is inserted. If each of the space holding members 3 is attached to the end portion of the electric resistance adjusting layer 2, the cylinder portion 3*a* of each of the space holding members 3 is fitted to the outer circumference surface 2*a* of the electric resistance adjusting layer 2, the end plate 3*b* of each of the space holding members 3 has contact with the end surface 2*b* of the electric resistance adjusting layer 2, and the central portion of the end plate 3*b* has contact with the conductive supporting body 1.

With this structure, each of the space holding members 3, 3 has contact with at least two surfaces of the outer circumference surface 2*a* and the end surface 2*b* of the end portion of the electric resistance adjusting layer 2, and also has contact with the conductive supporting body 1 to which the electric resistance adjusting layer 2 is fastened. Thereby, the space holding members 3, 3 can be firmly attached to the electric resistance adjusting layer 2. Therefore, the dropping out of the space holding members 3, 3 from the electric resistance adjusting layer 2, the deformation of the space holding members 3, 3 and the like which are generated if the finishing process is conducted on the surfaces of the space holing members, can be prevented.

Aside from this, each of the space holding members 3, 3 can be attached to a step portion having at least one step disposed in each of the end portions of the electric resistance adjusting layer 2.

More particularly, as shown in FIGS. 2, 3, each of the end portions of the electric resistance adjusting layer 2 is provided with a step portion 2*c* having at least one step, which is formed to slightly decrease the outer diameter of the end portion. When the cylinder portion 3*a* of each space holding member 3 is fitted to the step portion 2*c*, the end portion of the cylinder portion 3*a* of each space holding member 3 hits a vertical surface 2*d* of the step portion 2*c*. Accordingly, the each of the space holding member 3 is further firmly attached to the electric resistance adjusting layer 2.

As described above, the cylinder portion 3*a* of each space holding member 3 can be directly fitted to the outer circumference surface 2*a* without having the step portion of the electric resistance adjusting layer 2, or can be fitted to the outer circumference surface having the step portion 2*c* of the electric resistance adjusting layer 2.

In the charging roller 10 illustrated in FIGS. 1-3, the one step portion 2*c* is disposed in each end portion of the electric resistance adjusting layer 2. However, two step portions 2*e*, 2*f* can be disposed in each end portion of the electric resistance adjusting layer 2, for example, as shown in FIG. 4, and the inner surface of each of the space holding members 3 can be formed corresponding to those step portions. Thereby, each of the space holding members 3 is attached to the electric resistance adjusting layer 2. In this case, the space holding member 3 has contact with the two step portions 2*e*, 2*f* and vertical surfaces 2*g*, 2*h*, 2*i* comprising those step portions to be fixed thereto. Therefore, the space holding members 3, 3 are further firmly attached to the electric resistance adjusting layer 2.

In addition, the step portion of the electric resistance adjusting layer 2 is not limited to one step or two steps, and three steps or more (not shown) can be provided to the step portion.

With the above structure, as shown in FIG. 7, the charging roller 10 is formed with a gap G having a predetermined interval between the outer circumference surface of the image carrier 4 and the outer circumference surface of the electric resistance adjusting layer 2, when the outer circumference surfaces of the space holding members 3, 3 have contact with the image carrier 4.

As described above, if each of the cap-shaped space holing members 3, 3 is attached to the electric resistance adjusting layer 2, the space holding members 3, 3 are firmly attached to the electric resistance adjusting layer 2. In one embodiment, each of the cylinder portions of the space holding members 3, 3 is fitted to the outer circumference surface of the electric resistance adjusting layer 2 by press fitting. In this case, especially, if each of the cylinder portions of the space holding members 3, 3 is pressed into the step portion of the electric resistance adjusting layer 2, the space holding members 3, 3 can be fastened to the electric resistance adjusting layer for a long time even if the accuracy of the step portion and the space holding members 3, 3 is deteriorated in some degree. Moreover, when a finishing process is conducted in a state that the electric resistance adjusting layer 2 and the space holding members 3, 3 are combined, the rotation of space holding members 3, 3 by the processing force can be prevented.

In another embodiment, after the cylinder portion 3*a* of each of the space holding members 3, 3 is fitted to the outer circumference surface of the electric resistance adjusting layer 2, the cylinder portion 3*a* is fastened thereto with adhesive agent. As described above, if the space holding members 3, 3 are fastened to the electric resistance adjusting layer 2 with the adhesive agent, the space holding members 3, 3 can be securely fastened to the electric resistance adjusting layer 2 for a long time without being dropped off, even though the accuracy of the step portions and space holding members 3, 3 is deteriorated in some degree. Moreover, in the removal process that the electric resistance adjusting layer 2 and the space holding members 3, 3 are removed together, i.e., the finishing process (reference to FIG. 6), the rotation of space holding members 3, 3 by the processing force can be prevented. Also, the breaking off of the end portions of the space holding members 3, 3 by the stress of cutting tool during the finishing process of the space holding members, the dropping out from the electric resistance adjusting layer 2, the deformation of the space holding members 3, 3 and the like are unlikely to be generated. In this case, it is important for the adhesive agent to sufficiently adhere, so it is preferable for the material comprising the space holding members 3, 3 to use a PE, a polyurethane and the like.

In further another embodiment, the space holding members 3, 3 are fastened to the electric resistance adjusting layer 2 with adhesive agent via primer applied to the space holding members 3, 3. As just described, if the space holding members 3, 3 are fastened to the electric resistance adjusting layer 2 through the primer, the effective component of the primer permeates the space holding members 3, 3 for a long time, and the property of the surface of the bonding plane is modified to significantly improve the adhesion properties. Accordingly, although the accuracy of the step portions and the space holding members 3, 3 is slightly deteriorated, the space holding members 3, 3 can be absolutely fastened to the electric resistance adjusting layer 2 for a long time with the holding power between the resin and the adhesive force of the adhesive agent fixed through the primer without being dropped out from the electric resistance adjusting layer 2. Moreover, when the electric resistance adjusting layer 2 and the space holding members 3, 3 are removed together, the rotation of the space holding members 3, 3 by the processing force are prevented.

Figure 5:
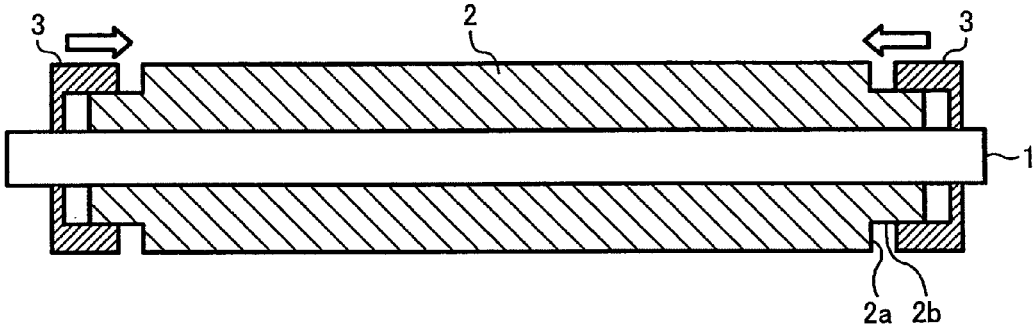
FIG. 5 is an explanation view explaining an attachment method of an electric resistance adjusting layer and space holding members in a conductive member (charging roller) showing one embodiment of the present invention.

A difference in height of each of the outer circumference surfaces of space holding members with respect to the outer circumference surface of electric resistance adjusting layer 2 is formed such that, at first, the space holding members 3, 3 are inserted into both ends of the electric resistance adjusting layer 2 having the step portions disposed in the vicinity of end portions in both ends direction, as shown in FIG. 5, next, the removal process such as a cutting process, grinding process, etc., is conducted to the outer circumference surfaces of the space holding members 3, 3 disposed onto the conductive member 10 and the outer circumference surface of the electric resistance adjusting layer 2 disposed onto the conductive supporting body 1 to be processed together. As a result, it becomes possible for the variations of difference in height to be ±10 μm or less. As just described, if the difference in height of the outer circumference surfaces of the space holding members 3, 3 with respect to the outer circumference surface of the electric resistance adjusting layer 2 is formed by the removal process such as a cutting process, grinding process, etc., conducted to the outer circumference surfaces of the space holding members 3, 3 disposed onto the conductive member 10 and the outer circumference surface of the electric resistance adjusting layer 2 disposed onto the conductive supporting body 1 to be processed together, the accuracy of gap G is further improved by reducing the fluctuation of gap G formed between the outer circumference surface of the image carrier 4 and the outer circumference surface of the electric resistance adjusting layer 2 as shown in FIG. 7.

The characteristic required for the space holding members 3, 3 is to stably form the gap G with the image carrier 4 for a long time and environment, so it is preferable for the material comprising the space holding members 3, 3 to use a material having small absorbability and abrasion quality. In addition, the space holding members 3, 3 slide by making contact with the image carrier 4 that the toner and toner added substance are hardly adhered, so it is important for the material comprising the space holding members to protect the image carrier 4 from wearing. The material comprising such space holding members 3, 3 is appropriately selected depending on various conditions, and it is preferable for the material comprising the space holding members 3, 3 to use a resin such as a polyethylene resin (PE), a polypropylene (PP), a polymethylmethacrylate (PMMA), a polystyrene (PS), and a polystyrene copolymer (AS, ABS), or a resin such as a PC, a polyurethane and a fluorine resin. The space holding members 3, 3 according to the present invention are formed by molding such resin.

As shown in FIG. 7, the conductive member 10 is disposed to have contact with the image carrier 4 with any pressure. Each of the space holding members 3, 3 is formed in a non-image forming area in addition to an image forming area. If the conductive member 10 is used as a charging member with this state, the image carrier 4 is charged by applying voltage to the conductive member 10. If the conductive member 10 is used as a toner carrier and transfer member, it can be used with the same embodiments. In this case, it is preferable to satisfy a width in electric resistance adjusting layer<a width in photoconductive layer.

In the present invention, the shapes of the conductive member 10 and the image carrier 4 are not specifically limited. The image carrier 4 can be a belt shape and cylinder shape. The conductive member 10 can be various shapes such as a circular section shape (cylinder shape), an ellipse section shape, and a blade shape that cylinder shape is flattened. However, it is preferable for the conductive member 10 and the image carrier 4 to be a cylinder shape, respectively. If the conductive member 10 and the image carrier 4 constantly face each other on the same plane, the surfaces are chemically deteriorated by the energizing stress. However, if the conductive member 10 and the image carrier comprise a cylinder shape, respectively, to be rotated, continuous discharge from the same portion can be prevented. Therefore, the chemical deterioration on the surfaces by the energizing stress can be reduced. For example, as shown in FIG. 7, the rotation direction of the conductive member 10 can be selected from the direction same as the image carrier 4 and the direction opposite to the image carrier 4. Moreover, the conductive member 10 can be rotated faster than the image carrier 4 and also rotated slower than the image carrier 4. Furthermore, the conductive member 10 can be intermittently rotated within a range, which does not damage the function, with respect to the rotation of image carrier 4.

The gap G between the conductive member 10 and the image carrier 4 is required to maintain a predetermined value. It is preferable for the gap G to be set 100 μm or less. If the gap G increases, it is necessary to increase the condition of superimposed voltage to the conductive member 10 because the image carrier 4 is electrically deteriorated and abnormal discharge is easily produced.

As described above, in each of the space holding members 3, 3, a part of the space holding member 3 includes a difference in height to the electric resistance adjusting layer 2 (reference to FIG. 7). Since it is preferable for the gap G between the conductive member 10 and the image carrier 4 to maintain a predetermined value, when the image area of image carrier 4 and the contact surfaces of space holding members 3, 3 have the same height, a condition, a height of a part of space holding member>a height of electric resistance adjusting layer, is required, and it is preferable for the difference in height to be 100 μm or less. Moreover, if the height of a portion of each space holding member neighboring the electric resistance adjusting layer 2 is formed to be the height same as the electric resistance adjusting layer 2, or is formed to be lowered, the contact width of the each of the space holding members 3, 3 and the image carrier 4 is reduced. Accordingly, the accuracy of gap G between the conductive member 10 and the image carrier 4 can be improved.

In one embodiment, each of the space holding members 3, 3 comprises an electric insulation resin material. It is preferable for the volume resistivity to be $10^{13}$ Ω·cm or more. As just described, if each of the space holding members 3, 3 comprises an electric insulation resin material, and the volume resistivity is $10^{13}$ Ω·cm or more, the generation of abnormal electric discharge (leak) current can be prevented between the space holding members 3, 3 and the base layer of the image carrier 4.

In this case, it is preferable for the volume resistivity of electric resistance adjusting layer 2 to be $10^6$-$10^9$ Ωcm. If the volume resistivity of electric resistance adjusting layer 2 exceeds $10^9$ Ω cm, the charging performance and transfer performance are lowered. Also, if the volume resistivity of electric resistance adjusting layer 2 is less than $10^6$ Ωcm, the leak is generated by the voltage concentrated to the entire image carrier 4.

If the volume resistivity of electric resistance adjusting layer 2 is $10^6$-$10^9$ Ω cm, sufficient charging performance and transfer performance can be ensured, and also the abnormal electric discharge by the power concentrated to the image carrier 4 can be prevented. Therefore, a uniform image can be obtained.

A resin used for the electric resistance adjusting layer 2 is not specifically limited. However, it is preferable to used a resin such as a polyethylene (PE), a polypropylene (PP), a polymethylmethacrylate (PMMA), a polystyrene (PS), and a polystyrene copolymer (AS, ABS) or a thermoplastic resin such as a PC, a polyurethane, and a fluorine resin because those resin has preferable workability. It is preferable for a high-molecular form ionic conductive member, which disperse into the resin, to use a high-molecular compound containing polyether ester amid. Since the polyether ester amid is a high-molecular material of ionic conductive, it is equally dispersed and fixed into a matrix polymer with a monocular level. Therefore, an electric resistance value is not varied by a dispersal defect as in a composition that electric conduction conductive agent such as a metal oxide and a carbon black is dispersed. In addition, since a polyether ester amide is a high-molecular material, bleeding out is unlikely to be caused. In order to obtain a predetermined electric resistance value, it is preferable to have blending quantity of a thermoplastic resin 30-70% by weight and a high-monocular ionic conductive agent 70-30% by weight. It is preferable for the thickness of electric resistance adjusting layer comprising such a resin to be 100 μm or more and 500 μm or less. If the thickness of electric resistance adjusting layer becomes less than 100 μm, the thickness becomes too thin. Consequently, abnormal electric discharge by leak is produced. Moreover, if the thickness of electric resistance adjusting layer exceeds 500 μm, the thickness becomes too thick. Consequently, the surface accuracy is hardly maintained.

A semi-conductive resin composition comprising such a material can be easily manufactured by melting and kneading the mixture of each material with a two-axel kneading machine, kneader, etc. The electric resistance adjusting layer 2 can be easily formed onto the conductive supporting body 1 by covering a semi-conductive resin composition onto the conductive supporting body 1 by means of extrusion molding, injection molding, etc. If the electric resistance adjusting layer 2 is only formed on the conductive supporting body 1 to comprise the conductive member 10, toner, addition agent of toner, and the like, are fixed to the electric resistance adjusting layer 2. Therefore, the performance of the conductive member 10 may be lowered. However, in the present invention, since a surface layer 12 is formed on the electric resistance adjusting layer 2, it is possible to prevent toner and addition agent added to the toner from adhering to the surface of the conductive member 10 for a long time.

The volume resistivity of surface layer 12 is set to be larger than the volume resistivity of electric resistance adjusting layer 2, for example. As just described, if the volume resistivity of surface layer is set to be larger than that of the electric resistance adjusting layer 2, voltage concentrated to a defective portion of image carrier and abnormal electric discharge can be prevented. However, if the electric resistance value of surface layer is too high, the charging performance and transfer performance are lowered. Therefore, it is preferable for a difference of electric resistance value between the surface layer and the electric resistance adjusting layer 2 to be 103 or less. It is preferable for a material comprising the surface layer to use a resin such as a fluorine type resin, a silicone type resin, a polyamide resin and a polyester. Such a resin is preferable in terms of prevention of fixing toner because such a resin is superior to non-adhesive property. Moreover, such a resin is electrically insulated, so the electric resistance of the surface layer can be adjusted by dispersing various conductive members to a resin. The surface layer is formed onto the electric resistance adjusting layer 2 by means of spray coating, dipping, roll coating and the like with a coating material that a resin material comprising the surface layer is solved into organic solvent. It is preferable for the film thickness of surface layer to be 10-30 μm.

Single liquid type and double liquid type can be used for the resin comprising the surface layer. If a double liquid type coating material, which uses hardening agent at the same time, is used, environmental resistance and non-adhesive property can be improved. In case of using the double liquid type coating material, it is general to use a method, which bridges and hardens the resin by heating a coated film.

However, if the electric resistance adjusting layer 2 comprises a thermoplastic resin, the electric resistance adjusting layer 2 can not be heated with high temperature. As the double liquid type coating material, it is preferable to use a base compound having a hydroxyl group in a molecule and isocyanate type resin, which causes bridging reaction with the hydroxyl group. If the isocyanate type resin is used, bridging and hardening reaction is produced with relatively low temperature of 100° C. or less. After the study of non-adhesive property of toner, the present inventors confirmed that a silicone type resin has high non-adhesive property of toner, and found that, especially, an acrylic silicone resin having an acrylic skeleton in the molecule is preferable.

Since electric characteristic (electric resistance value) is important for the conductive member, the surface layer of conductive member requires conductive properties. The conductive surface layer is formed by dispersing conductive agent into a resin material comprising the surface layer. The conductive agent is not limited, but it is preferable to use a conductive carbon such as a ketjenblack EC and an acetylene black, a rubber carbon such as a SAF, an ISAF, a HAF, a FEF, a GPF, a SRF, a FT and a MT, a color carbon that an oxidation treatment is conducted, a pyrolysis carbon, a metal and a metal oxide such as an indium dope tin oxide (ITO), an tin oxide, an titanium oxide, an znic oxide, a copper, a silver and a germanium, and a conductive polymer such as a polyaniline, polypyrrole, and polyacetylene. Moreover, a conductive applied material includes an ionic conductive material, an inorganic conductive material such as a sodium perchlorate, a lithium perchlorate, a calcium perchlorate and a lithium chloride, and an organic ionic conductive material such as a denaturated fatty acid dimethyl ammonium ethosulfate, an ammonium stearate acetate and a lauryl ammonium acetate.

Figure 6:
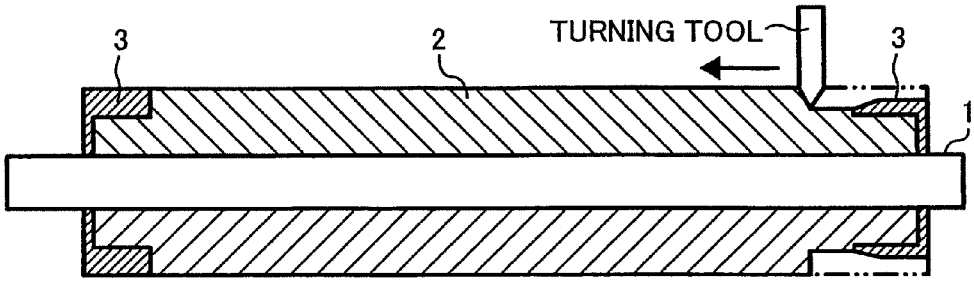
FIG. 6 is an explanation view illustrating a removal process method of outer circumference surfaces of space holding members and an outer circumference surface of electric resistance adjusting layer in a conductive member (charging roller) showing one embodiment of the present invention.

In order to obtain the conductive member 10, for example, a resin comprising the above described electric resistance adjusting layer 2 is disposed on the conductive supporting body 1 by means of injection molding, and the step portions are formed in the vicinity of the end portions of the electric resistance adjusting layer 2. Thereafter, as shown in FIG. 5, adhesive agent is applied to the step portions of the end portions of the electric resistance adjusting layer 2, and the space holding members 3, 3 are fitted to the end portions of the electric resistance adjusting layer that the adhesive agent is applied to be fixed with the adhesive agent. As shown in FIG. 6, in order to form a difference in height between the space holding members 3, 3 and the electric resistance adjusting layer 2, the outer diameter is finished by the finishing process such as cutting and grinding in a state that the space holding members 3, 3 and the electric resistance adjusting layer 2 are integrally molded.

Next, the surface layer is formed onto the electric resistance adjusting layer 2 in a state that the space holding members 3, 3 are protected, so as to obtain the conductive member 10.

The above conductive member is preferably formed as a charging member. Such a charging member can charge the surface of image carrier without having contact with the surface of image carrier. Therefore, the stain of charging member can be prevented, and also highly accurate charging member can be obtained by forming the charging member with a hard material. Accordingly, uneven charging can be prevented.

Figure 9:
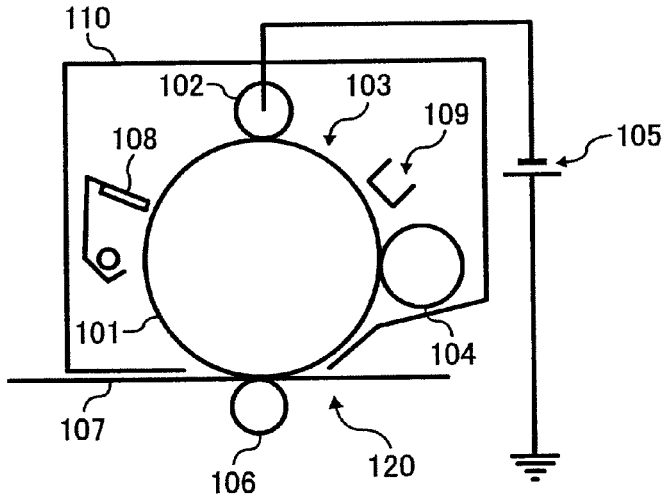
FIG. 9 is an explanation view of image forming apparatus using a conventional charging roller.

The conductive member (charging member) 10 is formed in a detachable process cartridge 110 (reference to FIG. 9), which is disposed to be placed adjacent to a body to be charged, for example, the image carrier.

As described above, if the charging member 10 is formed in the process cartridge, which is disposed to be placed adjacent to the image carrier, stable image quality can be obtained for a long time, and the exchanging can be simplified because user maintenance is available.

In the present invention, an image forming apparatus having the process cartridge 110 (reference to FIG. 9) is formed. As described above, if the image forming apparatus has the process cartridge, the reliability of the image forming apparatus is improved, and also a high quality image can be obtained.

Figure 8:
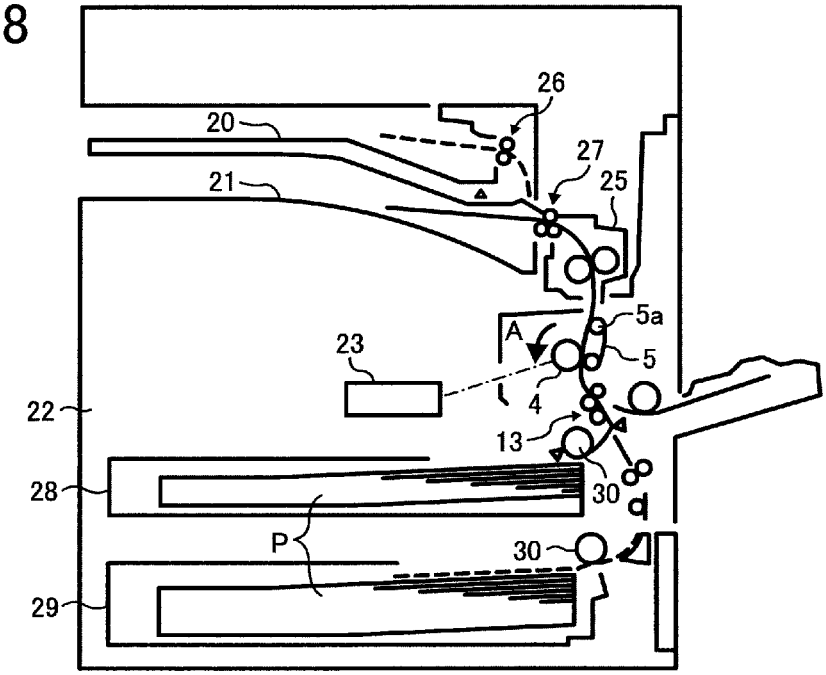
FIG. 8 is an explanation view of image forming device showing one embodiment of the present invention.

In the image forming apparatus according to the present invention, as shown in FIG. 8, the apparatus body is provided with a feeding paper portion in the lower portion of body, an image forming portion having the image carrier 4 thereabove, and a pair of discharging rollers 26, 27 as a discharging paper portion above the image carrier 4. With this image forming apparatus, an image is formed in the image forming portion corresponding to the left side surface of a transfer paper P fed from the feeding paper portion 22, and the transfer paper P is discharged to a bin-tray 20 or discharging paper tray 21 by the discharging rollers 26, 27. The feeding paper portion 22 is provided with two-tiered trays 28, 29, and a feeding paper roller 30 is disposed in each of the trays. Reference number 23 is a writing unit. Light is illuminated to the uniformly charged surface of the image carrier 4 from the writing unit, and an image is written therein. The upstream side of the paper transfer direction with respect to the image carrier 4 is provided with a pair of resist rollers 13, 13 in order to correct the skew of transfer paper and match the transfer timing of the image and the transfer paper on the image carrier 4.

Moreover, the downstream side of paper transfer direction with respect to the image carrier 4 is provided with a fixing unit 25. The image forming portion is provided with the above image carrier 4 rotatably in the arrow A direction, as shown in FIG. 8, and the charging device 102 (reference to FIG. 9), the developing device 104 (reference to FIG. 9) that the electrostatic latent image on the image carrier 4 written by the writing unit 23 on the surface charged by the charging device is developed to obtain a toner image, the transfer belt 5, which transfers the toner image onto the transfer paper P, the cleaning device 108 (reference to FIG. 9), which eliminates the toner remained on the image carrier 4 after the transfer of the toner image, and a removal electricity lamp (not shown), which eliminates unnecessary charge on the image carrier 4, are disposed around the image carrier 4. In the image forming apparatus, if the image forming operation is started, the image carrier 4 shown in FIG. 8 rotates in the arrow A direction, and the electricity of the surface is eliminated by the removal electricity lamp to be averaged to a reference electric potential. Next, the surface of image carrier 4 is uniformly charged by the charging roller 102 (reference to FIG. 9), and the charged surface receives the illumination of light corresponding to image information from the writing unit 23, and the electrostatic latent image is formed thereon. If the latent image is moved to the position of developing device 104 (reference to FIG. 9) by the rotation of the image carrier 4 in the arrow A direction, the latent image becomes the toner image (developed image) by the toner applied to the latent image by a developing sleeve (not shown).

On the other hand, the transfer paper P is fed by the paper feeding roller 30 from any of the trays 28, 29 of the paper feeding portion 22 illustrated in FIG. 8, the paper P is stopped once by a pair of resist rollers 13. Then, the paper P is transferred at an accurate timing that the leading end of the transfer paper P conforms to the leading end of image on the image carrier 4, and the toner image on the image carrier 4 is transferred onto the transfer paper P by the transfer belt 5. The transfer paper P is fed by the transfer belt 5, and is separated from the transfer belt 5 by curvature separation with the stiffness of the transfer paper P so as to be transferred to the fixing unit 25. The toner is melted and fixed to the transfer paper P by the applied heat and pressure in the fixing unit 25, and then the transfer paper P is discharged to a designated discharging place, i.e., the discharging paper tray 21 or bin-tray 20. Thereafter, the toner remained on the image carrier 4 is moved to the cleaning position of next process, and is removed by the cleaning blade 108 of cleaning device (reference to FIG. 9), and the apparatus moves on to the next image forming process.

In the present embodiment, the explanation is mainly given for the charging roller that the conductive member 10 is embodied. However, the conductive member 10 in the present invention can be a charging member in addition to the charging roller, for example, a blade, without departing from the purpose of the present invention. In addition, the conductive member 10 of the present invention can be a toner carrier or a transfer member.

Hereinafter, several experimental examples of a conductive member according to the present invention will be described.

EXPERIMENTAL EXAMPLE 1

A resin composition (volume resistivity: $2\times10^8$ Ωcm) was obtained by blending an ABS resin (DENKA ABS GR-0500, Denki Kagaku Kogyo Kabushikikaisha), 50% by weight and a polyether ester amide (IRGASTAT P18 Chiba Specialty Chemicals), 50% by weight, and the resin composition was coated onto a conductive supporting body (core shaft) having an outer diameter of 8 mm comprising a stainless by means of injection molding to form an electric resistance adjusting layer. This electric resistance adjusting layer has step portions, each having one step, in the vicinity of both end portions. The outer diameter of electric resistance adjusting layer was 14 mm, and the outer diameter of each of the step portions on both end portions was 11.3 mm. Cap-shaped space holding members comprising a high density polyethylene resin (NOVATEC PP HY540 Japan Polychem Corporation) were extrapolated and adhered onto both end portions of the electric resistance adjusting layer. Thereafter, the outer diameter (the maximum diameter) of each of the space holding members was reduced to 12.12 mm and the outer diameter of the electric resistance adjusting layer was reduced to 12.0 mm by means of cutting (reference to FIGS. 1-3). The thickness in the diameter direction of a ring shaped member 3*a* comprising the cut cap portion (hereinafter refereed to as A), thickness in a bottom portion 3*b* comprising this cap portion (hereinafter referred to as B), and length in the axial direction of the cap portion (hereinafter refereed to as C) were 0.4 mm, 2 mm and 8 mm, respectively. Next, a surface layer having about a film thickness of 10 μm was formed by a resin composition (volume reistivity: $2\times10^{10}$ Ωcm) comprising acrylic silicone resin (3000VH-P Kawakami Paint), an isocyanate type hardening agent and a carbon black (30% by weight relative to total dissolved solid) on the surface of resistance adjusting layer to obtain the conductive member.

EXPERIMENTAL EXAMPLE 2

A resin composition (volume resistivity: $2\times10^8$ Ωcm) was obtained by blending an ABS resin (DENKA ABS GR-0500, Denki Kagaku Kogyo Kabushikikaisha), 50% by weight and a polyether ester amide (IRGASTAT P18 Chiba Specialty Chemicals), 50% by weight, and the resin composition was coated onto a conductive supporting body (core shaft) having an outer diameter of 8 mm comprising a stainless by means of injection molding to form an electric resistance adjusting layer. This electric resistance adjusting layer has step portions, each having one step, in the vicinity of both end portions. The outer diameter of electric resistance adjusting layer was 14 mm, and the outer diameter of each of the step portions on both end portions was 11.1 mm. Cap-shaped space holding members comprising a high density polyethylene resin (NOVATEC PP HY540 Japan Polychem Corporation) were extrapolated and adhered onto both end portions of the electric resistance adjusting layer. Thereafter, the outer diameter (the maximum diameter) of each of the space holding members was reduced to 12.1 mm and the outer diameter of the electric resistance adjusting layer was reduced to 12.0 mm by means of cutting (reference to FIGS. 1-3). A, B and C of the cap portion after cutting were 0.5 mm, 2 mm and 8 mm, respectively. Next, a surface layer having a film thickness of about 10 μm was formed by a resin composition (volume reistivity: $2\times10^{10}$ Ωcm) comprising an acrylic silicone resin (3000VH-P Kawakami Paint), an isocyanate type hardening agent and a carbon black (30% by weight relative to total dissolved solid) on the surface of the resistance adjusting layer to obtain the conductive member.

EXPERIMENTAL EXAMPLE 3

A resin composition (volume resistivity: $2\times10^8$ Ωcm) was obtained by blending an ABS resin (DENKA ABS GR-0500, Denki Kagaku Kogyo Kabushikikaisha), 50% by weight and a polyether ester amide (IRGASTAT P18 Chiba Specialty Chemicals), 50% by weight, and the resin composition was coated around a conductive supporting body (core shaft) having an outer diameter of 8 mm comprising a stainless by means of injection molding to form an electric resistance adjusting layer. This electric resistance adjusting layer has step portions, each having one step extending in the axial direction, in the vicinity of both end portions of the electric resistance adjusting layer. The outer diameter of electric resistance adjusting layer was 14 mm, and the outer diameter of each of the step portions on both end portions was 10.9 mm. Cap-shaped space holding members comprising a high density polyethylene resin (NOVATEC PP HY540 Japan Polychem Corporation) were attached to both end portions of the electric resistance adjusting layer. Thereafter, the outer diameter (the maximum diameter) of each of the space holding members was reduced to 12.1 mm and the outer diameter of the electric resistance adjusting layer was reduced to 12.0 mm by means of cutting (reference to FIGS. 1-3). A, B and C of the cap portion after cutting were 0.6 mm, 2 mm and 8 mm, respectively. Next, a surface layer having a film thickness of about 10 μm was formed by resin composition (volume reistivity: $2\times10^{10}$ Ωcm) comprising an acrylic silicone resin (3000VH-P Kawakami Paint), an isocyanate type hardening agent and a carbon black (30% by weight relative to total dissolved solid) on the surface of the resistance adjusting layer to obtain the conductive member.

EXPERIMENTAL EXAMPLE 4

A resin composition (volume resistivity: $2\times10^8$ Ωcm) was obtained by blending an ABS resin (DENKA ABS GR-0500, Denki Kagaku Kogyo Kabushikikaisha), 50% by weight and a polyether ester amide (IRGASTAT P18 Chiba Specialty Chemicals), 50% by weight, and the resin composition was coated onto a conductive supporting body (core shaft) having an outer diameter of 8 mm comprising stainless by means of injection molding to form an electric resistance adjusting layer. This electric resistance adjusting layer has step portions, each having one step, in the vicinity of both end portions. The outer diameter of electric resistance adjusting layer was 14 mm, and the outer diameter of the step portion on both end portions was 10.9 mm. Cap-shaped space holding members comprising a high density polyethylene resin (NOVATEC PP HY540 Japan Polychem Corporation) were extrapolated and adhered onto both end portions of the electric resistance adjusting layer. Thereafter, the outer diameter (the maximum diameter) of each of the space holding members was reduced to 12.1 mm and the outer diameter of the electric resistance adjusting layer was reduced to 12.0 mm by means of cutting (reference to FIGS. 1-3). A, B and C of the cap portion after cutting were 0.5 mm, 1 mm and 8 mm, respectively. Next, a surface layer having a film thickness of about 10 μm was formed by a resin composition (volume reistivity: $2\times10^{10}$ Ωcm) comprising an acrylic silicone resin (3000VH-P Kawakami Paint), an isocyanate type hardening agent and a carbon black (30% by weight relative to total dissolved solid) on the surface of the resistance adjusting layer to obtain the conductive member.

COMPARATIVE EXAMPLE 1

A rubber composition (volume resistivity: $4\times10^{8}$ Ωcm) was obtained by blending an epichlorohydrin rubber (Epichlomer CG DAISO CO., LTD), 100% by weight and an ammonium perchlorate, 3% by weight, and the rubber composition was coated onto a conductive supporting body (core shaft) having an outer diameter of 8 mm comprising a stainless by means of extrusion molding so as to form a rubber coated layer. After that, a vulcanization process was performed to the rubber coated layer, and then the vulcanized rubber coated layer was finished to have an outer diameter of 12 mm by means of cutting to form an electric resistance adjusting layer. Next, a surface layer having a film thickness of about 10 μm was formed by a resin composition (volume reistivity: $2\times10^{10}$ Ωcm) comprising a polyvinyl butyral resin (DENKA butyral 3000-K, Denki Kagaku Kogyo Kabushikikaisha) an isocyanate type hardening agent and a tin oxide (25% by weight relative to total dissolved solid) was formed on the surface of the resistance adjusting layer. Next, ring-shaped space holding members, each having an outer diameter of 12.1 mm, comprising a polyamide resin (NOVAMID1010C2, Mitsubishi Engineering-Plastic Corporation) were inserted and adhered onto both end portions to obtain the conductive member.

COMPARATIVE EXAMPLE 2

A rubber composition (volume resistivity: $4\times10^{8}$ Ωcm) was obtained by blending an epichlorohydrin rubber (Epichlomer CG DAISO CO., LTD), 100% by weight and an ammonium perchlorate, 3% by weight, and the rubber composition was coated onto a conductive supporting body (core shaft) having an outer diameter of 8 mm comprising a stainless by means of extrusion molding to form a rubber coated layer. After that, a vulcanization process was performed to the rubber coated layer, and then the vulcanized rubber coated layer was finished to have an outer diameter of 12 mm by means of cutting to form an electric resistance adjusting layer. Next, a surface layer having a film thickness of about 10 μm was formed by a resin compound (volume reistivity: $2\times10^{10}$ Ωcm) comprising polyvinyl butyral resin (DENKA butyral 3000-K, Denki Kagaku Kogyo Kabushikikaisha), an isocyanate type hardening agent and a tin oxide (25% by weight relative to total dissolved solid) on the surface of the resistance adjusting layer. Tape-shaped members (DAITAC PF025-H, Dainippon Ink and Chemicals, Incorporated) comprising a polyethylene terephthalate resin (PET) having a thickness of 50 μm were coated around both ends at a width of 8 mm and a thickness of 60 μm to obtain the conductive member.

COMPARATIVE EXAMPLE 3

Figure 10:
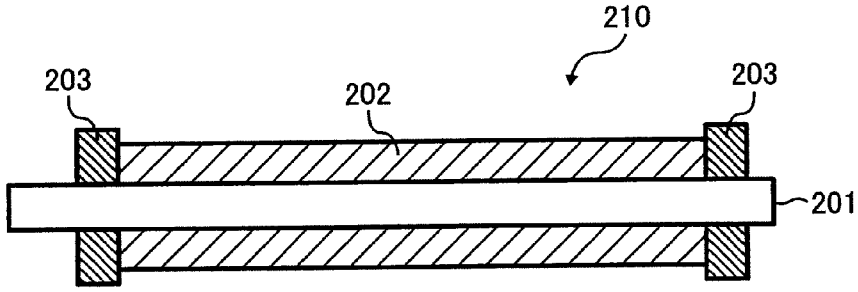
FIG. 10 is a cross section view of charging member proposed by the present inventors.
Figure 11:
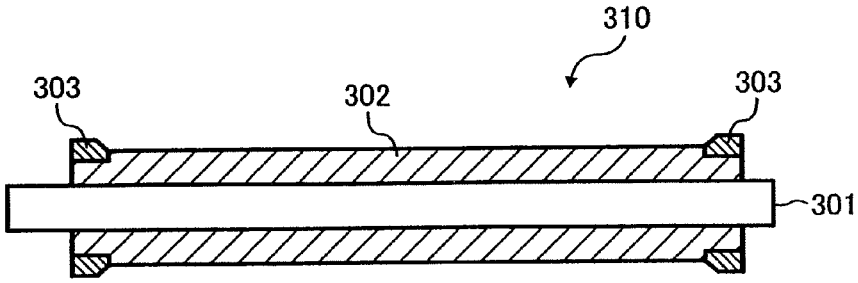
FIG. 11 is a cross section view of another charging member proposed by the present inventors.

A resin composition (volume resistivity: $2\times10^{8}$ Ωcm) was obtained by blending an ABS resin (DENKA ABS GR-0500, Denki Kagaku Kogyo Kabushikikaisha), 50% by weight and a polyether ester amide (IRGASTAT P18 Chiba Specialty Chemicals), 50% by weight, and the resin composition was coated onto a conductive supporting body (core shaft) having an outer diameter of 8 mm comprising a stainless by means of injection molding to form an electric resistance adjusting layer. Ring-shaped space holding members comprising a polyamide resin (NOVAMID 1010C2 Mitsubishi Engineering-Plastic Corporation) were extrapolated and adhered onto both end portions of the electric resistance adjusting layer. Thereafter, the outer diameter of each of the space holding member was reduced to 12.1 mm and the outer diameter of the electric resistance adjusting layer was reduced to 12.0 mm by means of cutting (reference to FIG. 10). Next, a surface layer having a film thickness of about 10 μam was formed by a resin composition (volume reistivity: $2\times10^{10}$ Ωcm) comprising a polyvinyl butyral resin (DENKA butyral 3000-K, Denki Kagaku Kogyo Kabushikikaisha), an isocyanate type hardening agent and a tin oxide (60% by weight relative to total dissolved solid) on the surface of the resistance adjusting layer to obtain the conductive member.

As described above, the conductive member (conductive roller) obtained in the experimental embodiments 1-4 and comparative examples 1-3 was mounted in the image forming apparatus shown in FIG. 8 as the charging member (charging roller), and the amount of gap between the charging member and the image carrier was measured under room temperature environment (23° C.60%RH). This image forming apparatus was left for 24 hours under the various environments such as LL; 10° C., 65% RH, HH; 30° C., 90% RH, and the amount of gap between the charging member and image carrier was measured under the various environments to calculate the changing amount of gap among the various conditions. Next, the voltage to be applied to the image forming apparatus was set to DC=−800 V, AC=2400 Vpp (frequency=2 kHz), and then 300,000 papers were passed. After that, the amount of gap between the charging member and image carrier, roller surface state and image were evaluated. As to the evaluation for the roller surface state and image, "good" means there is no problem for practical use. The evaluation environments were switched to various environments such as 23° C., 60% RH, LL ; 10° C., 65% RH, HH; 30° C., 90 with each 10,000 papers. The evaluation results are shown the following table 1.

TABLE 1

| | gap amount between charging member and image carrier (mm) | environmental fluctuation amount of gap (mm) | gap amount between charging member and image carrier after 300,000 papers pass (mm) | fixing of toner to roller surface after 300,000 papers pass | image after 300,000 papers pass |
|---|---|---|---|---|---|
| Experimental Example 1 | 0.05 ± 0.012 | 0.006 | 0.05 ± 0.013 | toner is not fixed | uneven image is not formed |
| Experimental Example 2 | 0.05 ± 0.010 | 0.008 | 0.05 ± 0.011 | toner is not fixed | uneven image is not formed |
| Experimental Example 3 | 0.05 ± 0.010 | 0.010 | 0.05 ± 0.011 | toner is not fixed | uneven image is not formed |

TABLE 1-continued

| | gap amount between charging member and image carrier (mm) | environmental fluctuation amount of gap (mm) | gap amount between charging member and image carrier after 300,000 papers pass (mm) | fixing of toner to roller surface after 300,000 papers pass | image after 300,000 papers pass |
|---|---|---|---|---|---|
| Experimental Example 4 | 0.05 ± 0.012 | 0.008 | 0.05 ± 0.013 | toner is not fixed | uneven image is not formed |
| Comparative Example 1 | 0.05 ± 0.030 | 0.023 | 0.04 ± 0.050 | toner is fixed | uneven image is formed |
| Comparative Example 2 | 0.03 ± 0.020 | 0.025 | 0.03 ± 0.040 | toner is fixed | uneven image is formed |
| Comparative Example 3 | 0.05 ± 0.012 | 0.023 | 0.05 ± 0.030 | toner is fixed | uneven image is formed |

The following results are known from the table 1. More particularly, in the conductive member (conductive roller) of the experimental examples 1-4, toner is not fixed onto the surface of roller after the papers are passed, and also unevenness of an image is not recognized. Accordingly, preferable results are obtained in the conductive member of the experimental examples 1-4. However, in the comparative examples 1-3, toner is fixed onto the surface of after papers are passed, and also an uneven image is formed after the papers are passed. Accordingly, defective results are obtained in the conductive member of the comparative examples 1-3.

According to the present invention, the electric resistance adjusting layer has step portions, each having one step or more, which are disposed to extend in an axial direction in the vicinity of end portions. Each of the space holding members has contact with the end surface of the electric resistance adjusting layer and the two surfaces comprising the step portion of the electric resistance adjusting layer to be fixed. A difference in height with respect to the outer circumference surface of electric resistance adjusting layer is provided in the outer circumference surface of each of the space holding members, such that a gap having a predetermined interval is formed between the outer circumference surface of image carrier and the outer circumference surface of the electric resistance adjusting layer when the outer circumference surface of each of the space holding members has contact with the image carrier. Thereby, the breaking off of end portions, which is generated during the finishing process conducted on the surfaces of space holding members, the deformation of the shape of space holding members and the like are prevented, and also the fluctuation of gap can be controlled if the measurement of electric resistance adjusting layer that the space holding members are disposed is changed by environmental fluctuation. Moreover, the gap between the image carrier and the conductive member is constantly maintained with high accuracy if the conductive member is used for a long time. Therefore, the conductive member, which can uniformly charge the surface of image carrier without generating abnormal electric discharge, can be provided.

Although the present invention has been described in terms of exemplary embodiments, it is not limited thereto. It should be appreciated that variations may be made in the embodiments described by persons skilled in the art without departing from the scope of the present invention as defined by the following claims. Moreover, no element and component in the present disclosure is intended to be dedicated to the public regardless of whether the element or component is explicitly recited in the following claims.

What is claimed is:

1. A conductive member that is configured to be used together with a photoconductor, the conductive member comprising:

a conductive supporting body;

an electric resistance adjusting layer including an outer circumferential surface having a diameter, which is formed on the conductive supporting body and is disposed to face the photoconductor, each of opposite ends of the electric resistance adjusting layer including first and second step portions; and a pair of space holding members, each of the space holding members including first and second stepped holes in which the first and second step portions are fitted, respectively, the first stepped hole and the second stepped hole each having a vertical surface that is transverse to a longitudinal axis of the respective space holding member, wherein the first step portion provided on the electric resistance adjusting layer includes a first vertical surface that is transverse to the longitudinal axis of the electric resistance adjusting layer and an outer circumferential surface having an outer diameter lesser than the diameter of the outer circumferential surface of the electric resistance adjusting layer, wherein the second step portion provided on the electric resistance adjusting layer includes a second vertical surface that is transverse to a longitudinal axis of the electric resistance adjusting layer and an outer circumferential surface having an outer diameter lesser than the diameter of the outer circumferential surface of the first step portion, and wherein, when the first and second step portions are fitted in the first and second stepped holes, the first step portion is fitted in the first stepped hole of each of the space holding members and the first vertical surface of the first step portion is abutted with the vertical surface of the first stepped hole, and the second step portion is fitted in the second stepped hole of each of the space holding members and the second vertical surface of the second step portion is abutted with the vertical surface of the second stepped hole, so that the pair of space holding members directly contact the photoconductor to maintain a predetermined gap between the electric resistance adjusting layer and the photoconductor.

2. The conductive member according to claim 1, wherein the conductive member is formed as a charging member.

3. A process cartridge, wherein the charging member set forth in claim 2 is disposed adjacent to a body to be charged.

4. An image forming apparatus comprising the process cartridge set forth in claim 3.

5. The conductive member according to claim 1, wherein a surface layer is formed on the electric resistance adjusting layer.

6. The conductive member according to claim 5, wherein a volume resistivity of the surface layer is larger than a volume resistivity of the electric resistance adjusting layer.

7. The conductive member according to claim 1, wherein, for each of the opposite ends of the electric resistance adjusting layer, the first and second step portions are press-fitted in the stepped hole of the corresponding space holding member.

8. The conductive member according to claim 1, wherein the first and second stepped holes of each of the space holding members are fitted onto the first and second step portions of the electric resistance adjusting layer and fixed thereto by adhesive agent.

9. The conductive member according to claim 1, wherein the first and second stepped holes of each of the space holding members are fitted onto the first and second step portions of the electric resistance adjusting layer by adhesive agent through primer applied to the space holding member.

10. The conductive member according to claim 1, wherein at least a portion, which has contact with the photoconductor, comprises an electric insulation resin material in each of the space holding members.

11. The conductive member according to claim 1, wherein a volume resistivity of each of the space holding members is $10^{13}$ Ω·cm or more.

12. The conductive member according to claim 1, wherein a volume resistivity of the electric resistance adjusting layer is $10^{6}$-$10^{9}$ Ω·cm.

13. The conductive member according to claim 1, wherein the conductive member comprises a cylindrical shape.

* * * * *